US007832670B2

(12) United States Patent
Peterson et al.

(10) Patent No.: US 7,832,670 B2
(45) Date of Patent: Nov. 16, 2010

(54) MATERIAL REDUCING APPARATUS

(75) Inventors: Arnold N. Peterson, Eugene, OR (US); Glenn Ford Bittrolf, Springfield, OR (US)

(73) Assignee: Astec Industries, Inc., Chattanooga, TN (US)

( * ) Notice: Subject to any disclaimer, the term of this patent is extended or adjusted under 35 U.S.C. 154(b) by 352 days.

(21) Appl. No.: 11/740,531

(22) Filed: Apr. 26, 2007

(65) Prior Publication Data

US 2007/0241218 A1 Oct. 18, 2007

Related U.S. Application Data

(63) Continuation-in-part of application No. 11/477,013, filed on Jun. 27, 2006, now Pat. No. 7,232,084, which is a continuation of application No. 10/804,781, filed on Mar. 19, 2004, now Pat. No. 7,090,157.

(51) Int. Cl.
*B02C 15/00* (2006.01)
*B02C 13/02* (2006.01)

(52) U.S. Cl. ..... 241/291; 241/186.4; 241/73; 241/186.35; 241/189.1

(58) Field of Classification Search ..... 241/73, 241/32, 186.35, 186.4, 189.1, 285.3, 291
See application file for complete search history.

(56) References Cited

U.S. PATENT DOCUMENTS 953,111 A 3/1910 Williams
RE17,120 E 10/1928 Keith
1,776,593 A 9/1930 Meyer
1,816,097 A 7/1931 Sumner
2,305,159 A * 12/1942 Heckman et al. ..... 460/106
3,868,062 A 2/1975 Cunningham et al.
4,318,512 A 3/1982 Jacobson et al.
4,385,732 A 5/1983 Williams
4,773,601 A 9/1988 Urich et al.
4,813,620 A 3/1989 Engelmohr et al.
4,836,457 A 6/1989 Greiner
5,213,273 A 5/1993 Linnerz
5,265,811 A 11/1993 Willibald
5,273,218 A 12/1993 Burns
5,358,189 A 10/1994 Vandermolen
5,417,375 A 5/1995 Peterson et al.
5,454,522 A 10/1995 Ballu
5,472,146 A 12/1995 Doppstadt
5,695,134 A 12/1997 Williams
5,743,472 A * 4/1998 Williams et al. ..... 241/32
5,947,395 A 9/1999 Peterson et al.
6,910,647 B2 6/2005 Alford et al.
7,090,157 B2 8/2006 Peterson et al.

* cited by examiner

*Primary Examiner*—Faye Francis
(74) *Attorney, Agent, or Firm*—Schwabe, Williamson & Wyatt

(57) ABSTRACT

Described herein is a material reducing apparatus including a bypass arm and a bypass control member for allowing reduction-resistant objects of a material to bypass the apparatus while avoiding interruption of the operation of the apparatus. Other embodiments may be described and claimed.

15 Claims, 5 Drawing Sheets

MATERIAL REDUCING APPARATUS

CROSS-REFERENCE TO RELATED APPLICATIONS

The present application is a continuation-in-part application of U.S. non-provisional application Ser. No. 11/477,013, entitled "MATERIAL REDUCING APPARATUS," filed on Jun. 27, 2006, which is a continuation application of U.S. non-provisional application Ser. No. 10/804,781, filed on Mar. 19, 2004 and issued on Aug. 15, 2006 as U.S. Pat. No. 7,090,157. The entire disclosures of both applications are hereby incorporated by reference in their entirety.

TECHNICAL FIELD

Embodiments of the present invention relate to machines and apparatuses for reducing material, e.g., for reducing material resulting from structural demolition to enable a more convenient transportation and disposal of such material.

BACKGROUND

Material reducing machines have long been used for reducing material from larger-sized components to smaller-sized components. Such reduction may be desirable for any one or more reasons including, for example, transportability, re-usability, and/or degradability.

In general, these machines operate by conveying un-reduced material toward a rotor having projections thereon, which may direct the material up and over the rotor into an overlying fixed anvil or anvil bar located in close proximity to the projections thereby breaking the material into smaller-sized components.

Known material-reducing machines may not be suitable or desirable for all types of materials, particularly if there is a possibility that reduction-resistant object may be encountered. For example, U.S. Pat. No. 5,213,273 issued to Linnerz ("Linnerz") discloses a material-reducing machine including an open hydraulic system that includes a hydraulic cylinder, a pressure relief valve, and an open receiving tank as the structure to provide for what it calls "resilient deflection" of its outlet wall. Linnerz, however, fails to include a biasing arrangement for urging or causing the outlet wall to move back to its operating position, such that the outlet wall remains deflected away, requiring operator intervention to close the outlet wall.

Some material-reducing machines are configured with a shear pin that breaks when a reduction-resistant object is encountered, resulting in the bypass wall pivoting open. As a result, the processing operation must be shut down and the shear pin must be replaced.

In still other cases, even more undesirable problems could result from a material-reducing machine encountering reduction-resistant material including, for example, damage to the machine, potentially leading to costly repairs or replacement thereof.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

The description may use the phrases "in an embodiment," "in embodiments," or "in various embodiments," which may each refer to one or more of the same or different embodiments. Furthermore, the terms "comprising," "including," "having," and the like, as used with respect to embodiments of the present invention, are synonymous.

The phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)." For the purposes of the present invention, the phrase "(A)B" means "(B) or (AB)," that is, A is an optional element.

The description may use perspective-based descriptions such as up/down, back/front, and top/bottom. Such descriptions are merely used to facilitate the discussion and are not intended to restrict the application of embodiments of the present invention.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

Figure 1:
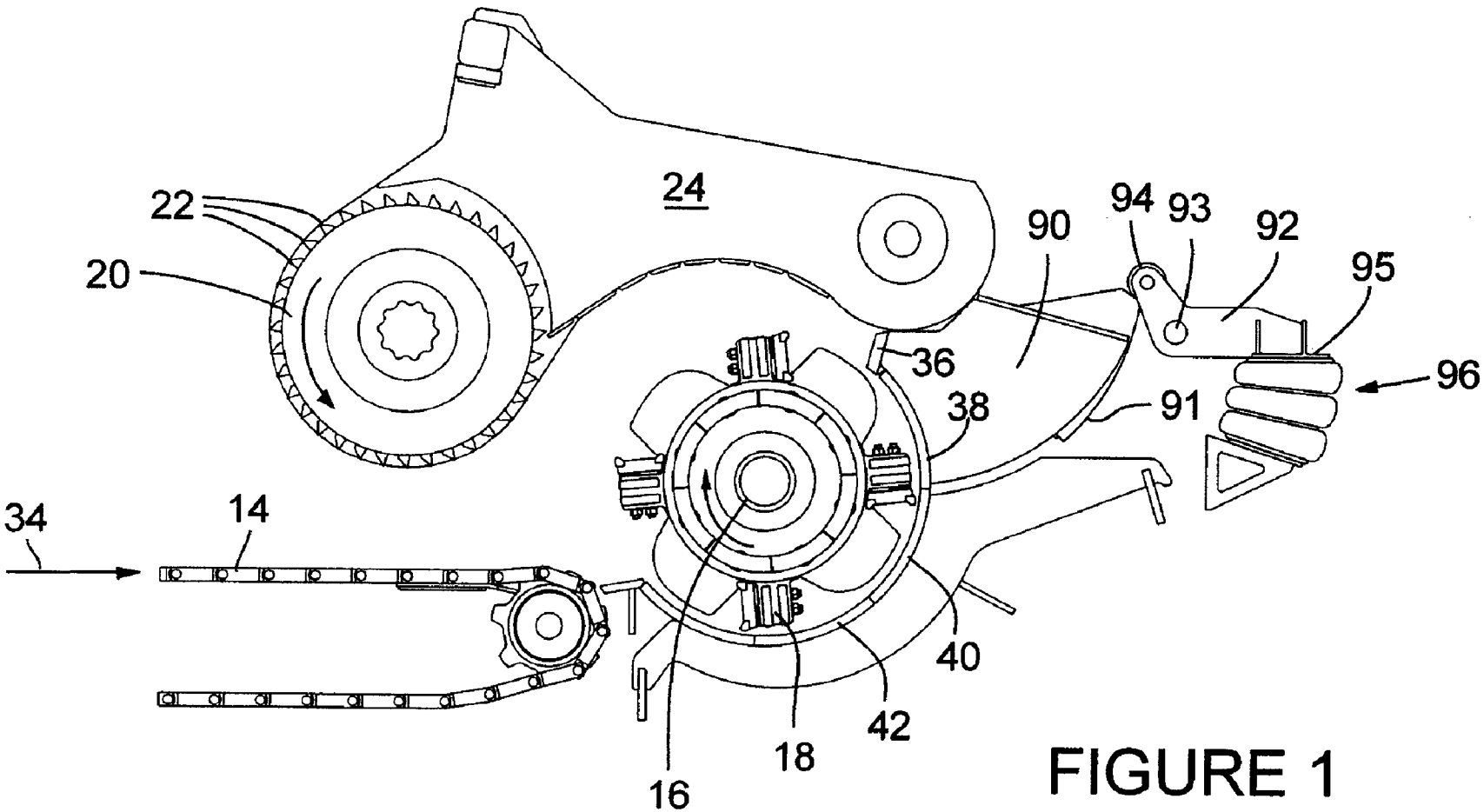
FIG. 1 is a schematic illustration of an exemplary material reduction apparatus, in accordance with various embodiments of the present invention.
Figure 2:
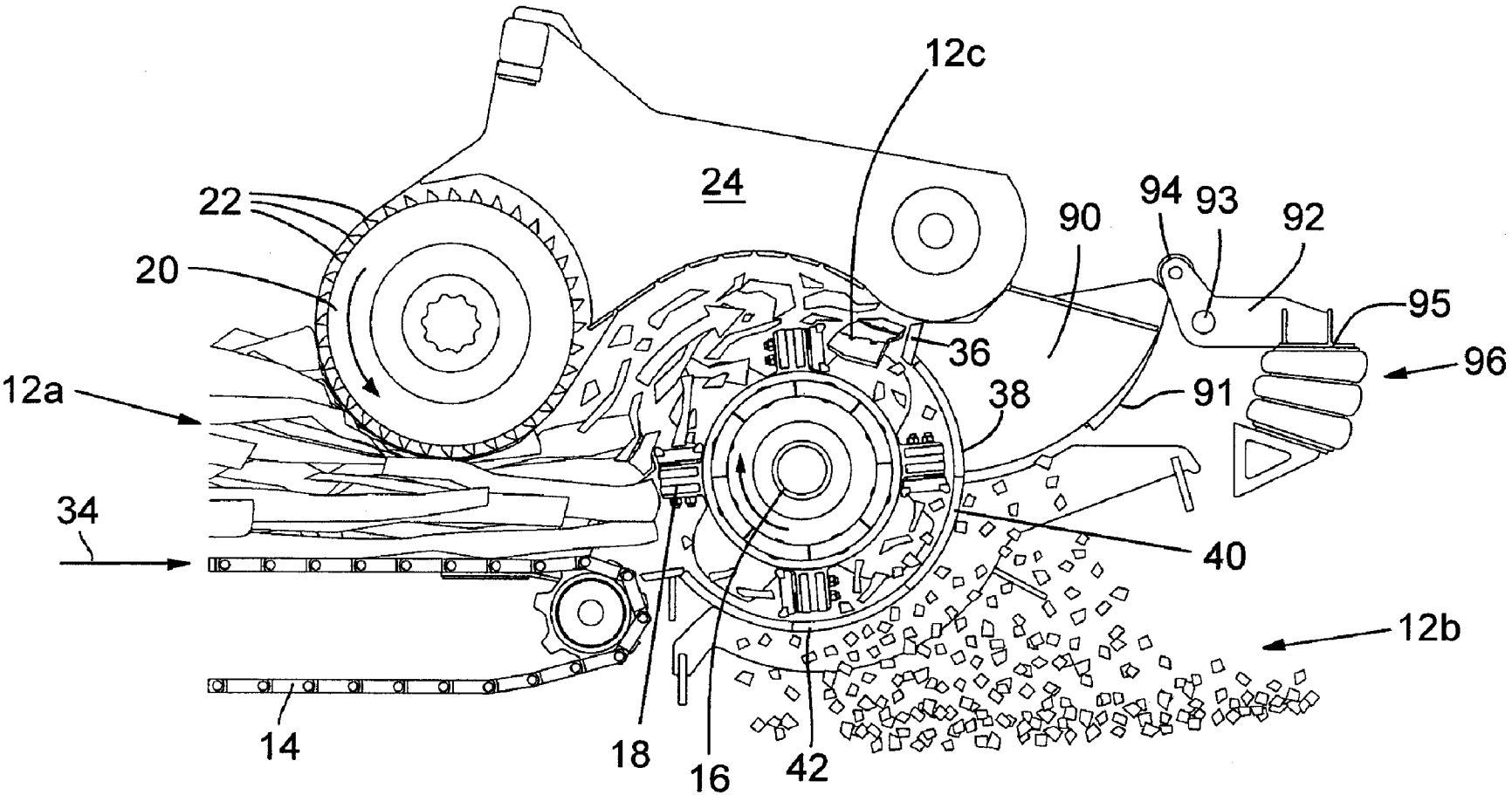
FIG. 2 is a schematic illustration of the material reduction apparatus of FIG. 1 in use, in accordance with various embodiments of the present invention.

FIGS. 1 and 2 depict a material reduction apparatus in accordance with various embodiments of the present invention. For the illustrated embodiment, the material reduction apparatus comprises a conveyor 14 for moving material to be reduced 12*a* toward a rotor 16 including radial projections 18 (sometimes referred to in the art as hammers). A compression roller 20 includes ribs 22 mounted on a pivotal arm 24. Compression roller 20 may be configured such that compression roller 20 is urged generally downward toward conveyor 14 and/or rotor 16. Compression roller 20 working in conjunction with conveyor 14 may urge material 12*a* downward and inward in the direction of arrow 34 toward rotor 16.

In operation and as illustrated in FIG. 2, material 12*a* may be forced against rotor 16 and/or projections 18 and is carried upwardly by projections 18 into engagement with an anvil 36 of a bypass arm 90. Material 12*a* that is too large to fit between the spacing provided between projections 18 and anvil 36 may be broken into smaller pieces upon impacting anvil 36.

Bypass arm 90 may further include a screen 38 following anvil 36 in around rotor 16. In various embodiments, following screen 38 may be one or more other screen sections 40, 42. Material 12*a* may be reduced by the apparatus into smaller pieces, which may then be urged by projections 18 against screens 38, 40, 42 and in some cases reduced further. Reduced material 12*b* may then pass through one or more of screens 38, 40, 42. In some embodiments, reduced material 12*b* may be deposited onto a conveyor for conveying away from the apparatus. Material 12*a* not passing through one or more of screens 38, 40, 42 may be moved around rotor 16 via projections 18 one or more additional cycles for further reduction and/or screening.

Figure 3:
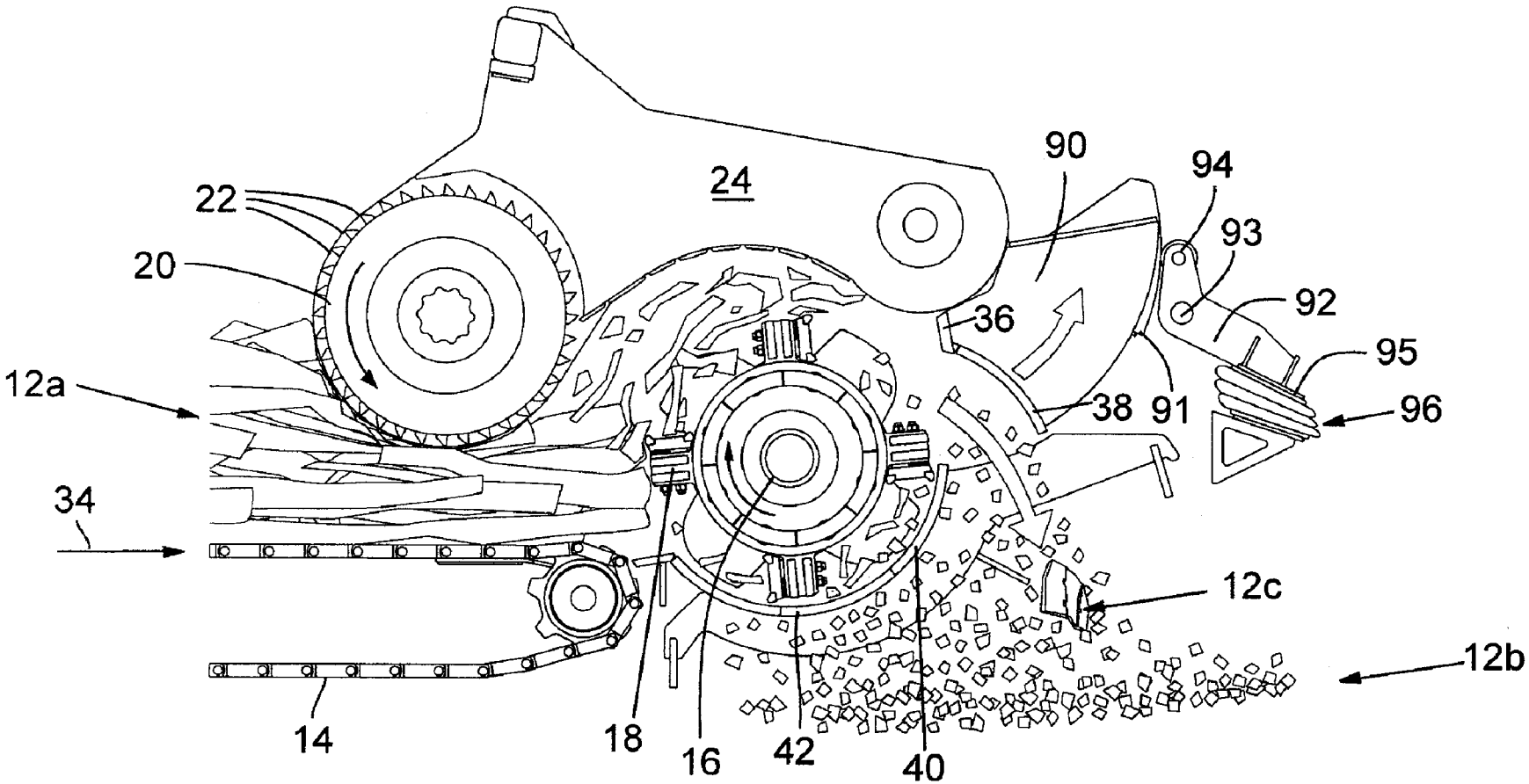
FIG. 3 is another schematic illustration of the material reduction apparatus of FIG. 1 in use, in accordance with various embodiments of the present invention.
Figure 4:
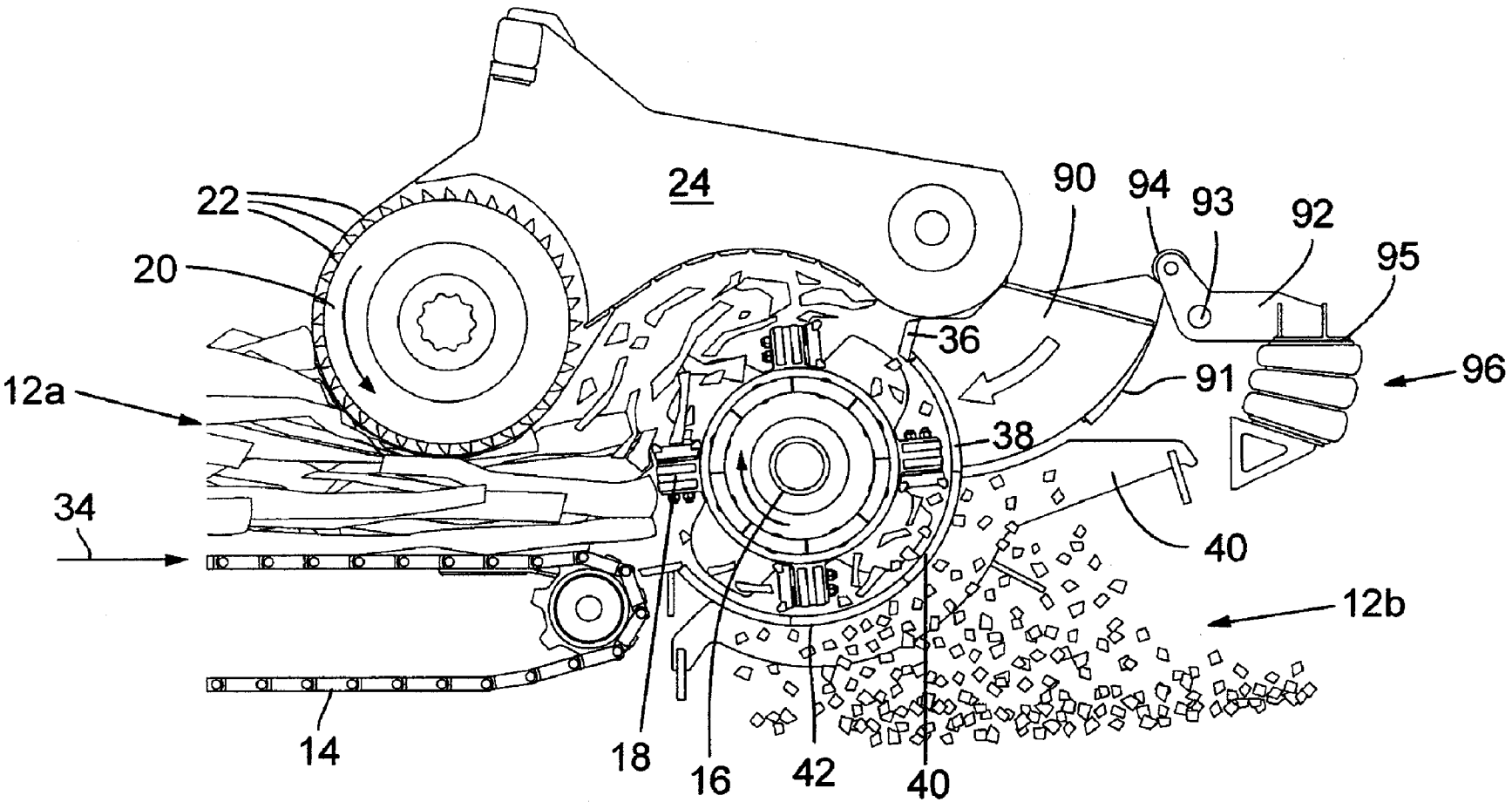
FIG. 4 is another schematic illustration of the material reduction apparatus of FIG. 1 in use, in accordance with various embodiments of the present invention.

Material to be reduced 12*a*, however, may include one or more reduction-resistant objects 12*c* as illustrated in FIGS. 2 and 3. Such reduction-resistant objects 12*c* may impact anvil 36, and the force of the impact, either alone or in combination with the added force of projections 18 due to the rotation of rotor 16, may result in pivoting of bypass arm 90 from a closed or operational position to a non-closed or open position for allowing reduction-resistant objects 12*c* to bypass the apparatus. In various embodiments, bypass arm 90 may open a varying amount depending on a number of factors including, but not limited to, reduction-resistant material size, opening force caused by reduction-resistant objects 12*c*, and/or the resistance force applied by bypass arm 90. Allowing reduction-resistant material 12*c* to bypass the machine may avoid jamming of the rotor and/or damage to one or more components of the apparatus. Costly downtime, repairs, and/or replacement may thus be avoided or minimized.

To allow bypass of reduction-resistant objects 12*c*, the material reducing apparatus may include a bypass arm 90 configured to pivot between a closed position and a non-closed position (illustrated in FIG. 3) to allow reduction-resistant objects 12*c* of material 12*a* to bypass the apparatus. A non-closed position may be any one or more positions of bypass arm 90 once bypass arm 90 has begun to pivot including, for example, fully open or any position between fully open and fully closed. Such pivoting of bypass arm 90 may be controlled, at least in part, by a bypass control member configured to move in relation to bypass arm 90 in order to allow bypass arm 90 to move between closed and non-closed positions.

In the illustrated embodiment, the bypass control member may be a lever 92, which may be configured to pivot about pivot point 93 between a first position when bypass arm 90 is in a closed position and a second position when bypass arm 90 is in the non-closed position.

As illustrated, bypass control lever 92 may include a first interface feature 94 engaging an interface surface 91 of bypass arm 90 and a second interface feature 95 coupled to a resistance element 96. First interface feature 94 may be disposed on a first end of bypass control lever 92, with first interface feature 94 being configured to engage interface surface 91 of bypass arm 90 to allow bypass arm 90 to pivot between the closed position and the non-closed position.

In various embodiments, while reducing normally-reducible material, first interface feature 94 may rest at a home position of surface 91. In such a position, the first interface feature 94 may apply a predetermined force to bypass arm 90 in order to hold bypass arm 90 in the closed position until a force exceeding the predetermined force is provided by an impact of reduction-resistant objects 12*c*. When the predetermined force is overcome by the force caused by the reduction-resistant material, the interface feature and/or the interface surface will move relative to each other so as to allow bypass arm 90 to pivot to a non-closed position.

In various embodiments, first interface feature 94 may be configured to rotate such that it can rotatably or rollably engage surface 91 of bypass arm 90, while bypass arm 90 pivots between closed and non-closed positions. For example, in various embodiments, first interface feature 94 may comprise a roller or other rolling structure. Although the illustrated embodiments depict first interface feature 94 as having a generally circular shape, other configurations are possible within the scope of the present disclosure.

For example, in some embodiments, first interface feature 94 may have an elliptical or other suitable shape. In other embodiments, however, first interface feature 94 may instead be configured to slidably engage surface 91, with first interface feature 94 and/or surface 91 of bypass arm 90 being formed of a suitable material and/or geometry that allows first interface feature 94 to slide relative to surface 91 of bypass arm 90. For example, in one embodiment, first interface feature 94 and/or surface 91 may be formed from and/or coated with a low- or no-friction material.

Surface 91 of bypass arm 90 may take any one or more configurations. For example, surface 91 may be integral to bypass arm 90 or may be formed by affixing a separate element to bypass arm 90. In embodiments, for example, surface 91 may be a plate or plate-like structure affixed to bypass arm 90. Surface 91, whether integral or separately affixed, may be a generally smooth surface or may include one or more notches, detents or other interrupting features disposed thereon and/or therein. Such interrupting features may be configured to engage first interface feature 94 to inhibit, at least temporarily, movement of bypass arm 90 relative to first interface feature 94. For example, in some embodiments, a notch or detent may be configured to engage first interface feature 94 to inhibit movement of bypass arm 90 until a reduction-resistant object 12*c* is encountered (e.g., similar to the angularly offset home position illustrated and discussed above).

In still further embodiments, interruption features may provide somewhat stepped but increased resistance to continued opening movement of bypass arm 90 as first interface feature 94 engages one or more of the detents until the reduction-resistant object 12*c* has passed. In other embodiments and as illustrated in FIGS. 1-4, however, surface 91 may be generally smooth with first interface feature 94 resting on a top edge of surface 91 (i.e., the home position) until reduction-resistant material 12*c* is encountered.

In various embodiments, surface 91 may be geometrically configured with a contour adapted to provide a predetermined range and/or variation of resistance forces for resisting pivoting of bypass arm 90 from a closed position to a non-closed position. Such a configuration may also urge bypass arm 90 from the non-closed position towards the closed position. "Contour" as used herein may include a generally regularly curved surface (whether convex or concave), a generally irregularly curved surface, a generally flat surface, and/or a combination thereof, depending on the particular application.

For example, the contour of surface 91 may be configured to provide a generally flat first or home position engagable by the first interface feature 94 and adapted to provide a predetermined force for holding bypass arm 90 in a closed position. When a reduction-resistant object 12*c* is encountered, the resistance forces applied to bypass arm 90 may increase until the force generated by the reduction-resistant object 12*c* exceeds the predetermined force generated by first interface feature 94 engaging the home position, at which time bypass arm 90 will move to the non-closed position (e.g., first interface feature 94 moves from the home position). In various embodiments, the contour of surface 91 may be configured to provide relatively low resistance such that the reduction-resistant object 12*c* is more readily bypassed. In various embodiments, surface 91 may be configured such that as bypass arm 90 pivots to non-closed positions higher resistance forces may be generated to urge bypass arm 90 back to the closed position; such varying resistance may be caused by the geometry of the interface surface 91.

In addition to or instead of contouring of surface 91 for providing a varying range of resistance forces, resistance element 96 coupled to a second interface feature of the bypass control member (as illustrated, lever 92) may be configured to resist pivoting of bypass control lever 92 as desired. For example, resistance element 96 may be configured to provide a predetermined range and/or variation of resistance forces for resisting pivoting of bypass control lever 92, and thus pivoting of bypass arm 90.

Resistance element 96 may comprise any one or more of various forms and materials and still be suitable for the purpose. For example, for various embodiments, resistance element 96 may comprise one or more airbags or airbag-like structures, one or more biasing elements (e.g., elastomeric structures, springs, etc.), or some combination thereof. In embodiments wherein resistance element 96 comprises an airbag(s), one or more of the airbags may be formed from any material suitable for the purpose including, for example, a polymer or a fabric, or some other material suitable for holding air or some other gas while still providing a desired level of elasticity. For embodiments wherein resistance element 96 comprises multiple airbags, the airbags may be stacked or may be distributed horizontally within the same plane, or some combination of both configurations.

In some embodiments, resistance element 96 may comprise one or more biasing elements such as, for example, springs. For embodiments wherein resistance element 96 comprises multiple biasing elements, the biasing element may be stacked or may be distributed horizontally within the same plane, or some combination of both configurations.

In various embodiments, and similarly to various embodiments of surface 91 described above, resistance element 96 may be configured to provide a predetermined force for holding and/or facilitating holding of bypass arm 90 in a closed position until bypass arm 90 encounters a reduction-resistant object 12*c* at which point resistance forces may increase until the force generated by the reduction-resistant object 12*c* exceeds the predetermined force. To allow the reduction-resistant object 12*c* to be bypassed from the apparatus, resistance element 96 may be further configured to taper off the resistance or otherwise reduce to allow bypass arm 90 to pivot to a non-closed position. In other embodiments, however, resistance element 96 may be configured to provide relatively low resistance once the predetermined force is exceeded such that the reduction-resistant object 12*c* is more readily bypassed, and in these embodiments, resistance element 96 may be configured such that as bypass arm 90 pivots to non-closed positions higher resistance forces may be generated to urge bypass arm 90 back the closed position.

Although various embodiments may provide for controlling the range of resistance forces for resisting pivoting of bypass control lever 92, and thus bypass arm 90, either by including resistance element 95 or by including a contoured surface 91, an increased range and/or variation of resistances may be possible by including both. For example, the resistance forces possible by either resistance element 95 or contoured surface 91 alone may be limited due to either the mechanical limits of those elements and/or by the materials available for forming those elements. Combining both elements may advantageously allow for an increased resistance force. Similarly, the variation of resistance forces may be more controllable or variable if both elements are combined. In some embodiments, however, use of either resistance element 95 or by contouring surface 91 alone may be suitable for the material reducing needs for the particular application.

Figure 5:
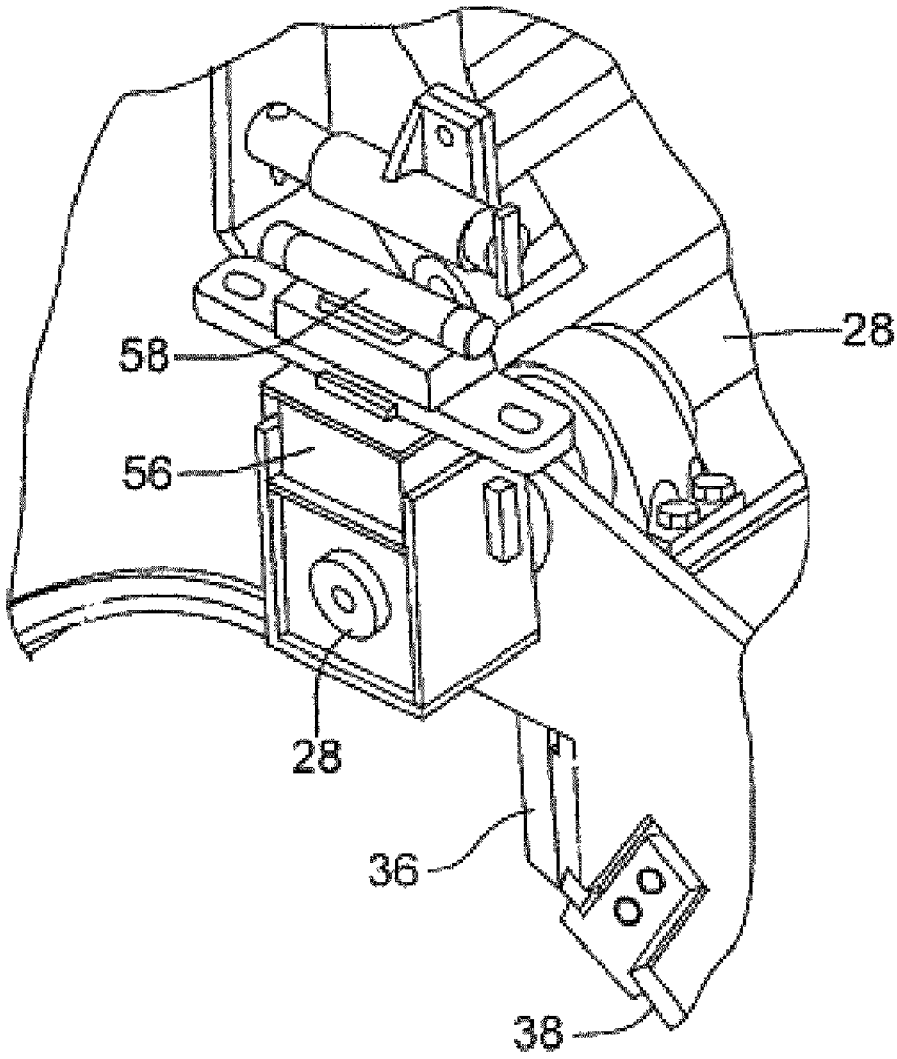
FIG. 5 is another schematic illustration of the material reduction apparatus of FIG. 1, showing the compression pad and shear pin in greater detail, in accordance with various embodiments of the present invention.

As illustrated in FIG. 5, seated above the shaft 28 is a compression pad 56 that permits limited upward movement of the shaft 28 as a stress relief, e.g., when the material reducing apparatus is overloaded. Also observed in FIG. 5 is a shear pin 58 that may be configured to act as a safety provision in the rare occasion when one or more reduction-resistant objects 12*c* are encountered by the material reducing apparatus, causing breakage of the shear pin 58. In these situations, the material reducing apparatus may then be shut down for shear pin replacement.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. For example, while a lever has been shown for the bypass control member, a variety of different structures may be used, including but not limited to slides, hinged members, etc. Further, the interface features may be of a variety of configurations other than those illustrated. The contour of the surface may be any one of a number of geometries aside from the illustrated increasing radius of curvature curved surface, including being generally flat. The home position may be angularly offset from the curved portion of the interface surface (as illustrated), or, for example, it may be of a different geometry, indented, protruded, or otherwise distinguished from the remainder of the interface surface and adapted to help provide an initial resistance force to hold the bypass arm in the closed position. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A materials reduction apparatus comprising:

a bypass arm configured to pivot between a closed position and a non-closed position to allow a reduction-resistant object of a material to bypass the apparatus; and a bypass control member configured to move between a first position when the bypass arm is in a closed position and a second position when the bypass arm is in the non-closed position, the bypass control member including a first end configured to traverse an interface surface of an exterior wall of the bypass arm, and a second end engaging a resistance member configured to urge the first end against the bypass arm to move the bypass arm to the closed position.

2. The apparatus of claim 1, wherein the exterior wall of the bypass arm has a first portion and a second portion angularly disposed from the first portion.

3. The apparatus of claim 2, wherein the second portion is generally curved.

4. The apparatus of claim 3, wherein the exterior wall of the bypass arm is convexly curved relative to the first end of the bypass control member.

5. The apparatus of claim 4, wherein the convexly curved surface of the bypass arm provides a resistance force in the open position that is greater than a resistance force in the closed position.

6. The apparatus of claim 3, wherein the second portion has a non-constant radius of curvature.

7. The apparatus of claim 1, wherein the exterior wall of the bypass arm is generally flat.

8. The apparatus of claim 1, wherein the first end of the bypass control member comprises a roller configured to traverse the exterior wall of the bypass arm.

9. The apparatus of claim 1, wherein the resistance element is configured to resist movement of the bypass control member from the first position and the second position.

10. The apparatus of claim 9, wherein the resistance element comprises at least a selected one or more of an airbag, a spring, and an elastomer.

11. The apparatus of claim 9, wherein the resistance element urges the bypass control member to return to the first position and thereby to urge the bypass arm to pivot towards the closed position.

12. The apparatus of claim 9, wherein the resistance element is configured to provide resistance force in the open position that is greater than a resistance force in the closed position.

13. The apparatus of claim 1, wherein the bypass arm is pivotally coupled to a shaft, and wherein the apparatus further comprises a shear pin coupled to the shaft and adapted to shear when the bypass arm encounters the reduction-resistant object.

14. The apparatus of claim 1, wherein the bypass arm is pivotally coupled to a shaft, and wherein the apparatus further comprises a compression member coupled to the shaft to allow limited generally linear movement of the shaft.

15. The apparatus of claim 1, wherein the first end of the bypass control member is configured to roll on the interface surface of the exterior wall of the bypass arm.

* * * * *